US009299491B2

(12) United States Patent
Wakibayashi et al.

(10) Patent No.: US 9,299,491 B2
(45) Date of Patent: Mar. 29, 2016

(54) TRANSFORMER COIL

(71) Applicant: Murata Manufacturing Co., Ltd., Nagaokakyo-shi, Kyoto-fu (JP)

(72) Inventors: Takashi Wakibayashi, Nagaokakyo (JP); Kiyoshi Hiramatsu, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 14/607,169

(22) Filed: Jan. 28, 2015

(65) Prior Publication Data

US 2015/0137928 A1 May 21, 2015

Related U.S. Application Data

(63) Continuation of application No. PCT/JP2013/069868, filed on Jul. 23, 2013.

(30) Foreign Application Priority Data

Aug. 1, 2012 (JP) ..... 2012-171208

(51) Int. Cl.
*H01F 27/29* (2006.01)
*H01F 27/30* (2006.01)
*H01F 27/28* (2006.01)
(Continued)

(52) U.S. Cl.
CPC ..... *H01F 27/2823* (2013.01); *H01F 5/02* (2013.01); *H01F 5/04* (2013.01); *H01F 27/2828* (2013.01); *H01F 27/29* (2013.01); *H01F 27/306* (2013.01); *H01F 2005/043* (2013.01)

(58) Field of Classification Search
CPC ..... H01F 5/02; H01F 2005/043
USPC ..... 336/192, 198
See application file for complete search history.

(56) References Cited

U.S. PATENT DOCUMENTS

2004/0190312 A1* 9/2004 Takada ..... 363/21.12

FOREIGN PATENT DOCUMENTS

JP 07-010920 U 2/1995
JP 08-162336 A 6/1996
(Continued)

OTHER PUBLICATIONS

English translation of JP09213558.*
(Continued)

*Primary Examiner* — Elvin G Enad
*Assistant Examiner* — Ronald Hinson
(74) *Attorney, Agent, or Firm* — Keating & Bennett, LLP

(57) ABSTRACT

A bobbin includes a core portion extending in a z-axis direction, a flange portion at an end of the core portion on a negative direction side of the z-axis direction and extending from the core portion in an x-axis direction and a y-axis direction, and a projecting portion projecting toward the negative direction side of the z-axis direction from a surface S1 on the negative direction side of the flange portion in the z-axis direction. Pin terminals project from the surface S1 of the flange portion toward the negative direction side of the z-axis direction. A winding is wrapped around the core portion, with both ends respectively wrapped around the pin terminals. Both ends of the winding are respectively soldered to the pin terminals at a region between an end portion of the projecting portion on the negative direction side of the z-axis direction and the surface S1 of the flange portion.

20 Claims, 8 Drawing Sheets

(51) Int. Cl.
*H01F 5/02* (2006.01)
*H01F 5/04* (2006.01)

(56) References Cited

FOREIGN PATENT DOCUMENTS

| | | | |
|---|---|---|---|
| JP | 09-213558 | A | 8/1997 |
| JP | 11-219840 | A | 8/1999 |
| JP | 2000-182848 | A | 6/2000 |
| JP | 2002-190405 | A | 7/2002 |
| JP | 2004-311759 | A | 11/2004 |
| JP | 2005-252107 | A | 9/2005 |
| JP | 2007-049105 | A | 2/2007 |
| JP | 2010-153659 | A | 7/2010 |

OTHER PUBLICATIONS

English translation of JP2010153659.*
Official Communication issued in International Patent Application No. PCT/JP2013/069868, mailed on Aug. 27, 2013.

* cited by examiner

TRANSFORMER COIL

BACKGROUND OF THE INVENTION

1. Field of the Invention

The present invention relates to transformer coils, and particularly relates to transformer coils including at least two windings wrapped around a coil shaft.

2. Description of the Related Art

The transformer coil disclosed in Japanese Unexamined Patent Application Publication No. 8-162336, for example, is known as a conventional transformer coil. FIG. 8 is a plan view of a transformer coil 500 disclosed in Japanese Unexamined Patent Application Publication No. 8-162336.

The transformer coil 500 includes a coil bobbin 502, a pin terminal 510, and a winding 520. The coil bobbin 502 is configured of a core 504, an upper flange 506, and a lower flange 508. The core 504 extends in a vertical direction. The upper flange 506 is connected to an upper end of the core 504. The lower flange 508 is connected to a lower end of the core 504.

In addition, a groove 512 that extends in the vertical direction is provided in a side surface of the lower flange 508. The pin terminal 510 protrudes downward from a bottom surface of the lower flange 508.

The winding 520 is wrapped around the core 504. Furthermore, the winding 520 is guided by the groove 512 and is drawn out from the bottom surface of the lower flange 508. Both ends of the winding 520 are wrapped around the pin terminal 510.

In the transformer coil 500 disclosed in Japanese Unexamined Patent Application Publication No. 8-162336, the winding 520 is covered by an insulative material. Accordingly, to connect the winding 520 and the pin terminal 510, the winding 520 is wrapped around the pin terminal 510 and is dipped in a solder liquid. At this time, the liquid surface of the solder liquid is located at a base of the pin terminal 510 (that is, at a location L0). The covering of the winding 520 is thus melted by heat from the solder liquid. As a result, the winding 520 and the pin terminal 510 are connected by the solder.

Incidentally, the solder liquid wets upward along the winding 520. There is thus a risk that the cover of the winding 520 located within the groove 512 will also be melted. Accordingly, in the transformer coil 500 disclosed in Japanese Unexamined Patent Application Publication No. 8-162336, a width of an upper portion of the groove 512 is smaller than a width of a lower portion of the groove 512. The solder liquid is suppressed from wetting upward within the groove 512 as a result.

However, with the transformer coil 500 disclosed in Japanese Unexamined Patent Application Publication No. 8-162336, there is a risk that the cover of the winding 520 located within the groove 512 will melt due to heat transmitted from the solder liquid to the winding 520.

SUMMARY OF THE INVENTION

Accordingly, preferred embodiments of the present invention provide a transformer coil capable of preventing a cover of a winding from melting in portion other than a portion that is wrapped around a terminal.

A transformer coil according to an aspect of various preferred embodiments of the present invention includes a bobbin including a core portion that extends in a predetermined direction, a flange portion that is provided at an end of the core portion on one side of the predetermined direction and extends from the core portion in a perpendicular or substantially perpendicular direction that is perpendicular or substantially perpendicular to the predetermined direction, and a projecting portion that projects toward the one side in the predetermined direction from a first surface on one side of the flange portion in the predetermined direction; two first terminals that project from the first surface of the flange portion toward the one side in the predetermined direction; and a first winding that is wrapped around the core portion and whose both ends are respectively wrapped around the two first terminals; wherein both ends of the first winding are respectively soldered to the two first terminals at a region between an end portion of the projecting portion on the one side in the predetermined direction and the first surface of the flange portion.

According to various preferred embodiments of the present invention, the covering of portions of a winding other than a portion wrapped around a terminal is prevented from melting.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, transformer coils according to various preferred embodiments of the present invention will be described with reference to the drawings.

Figure 1:
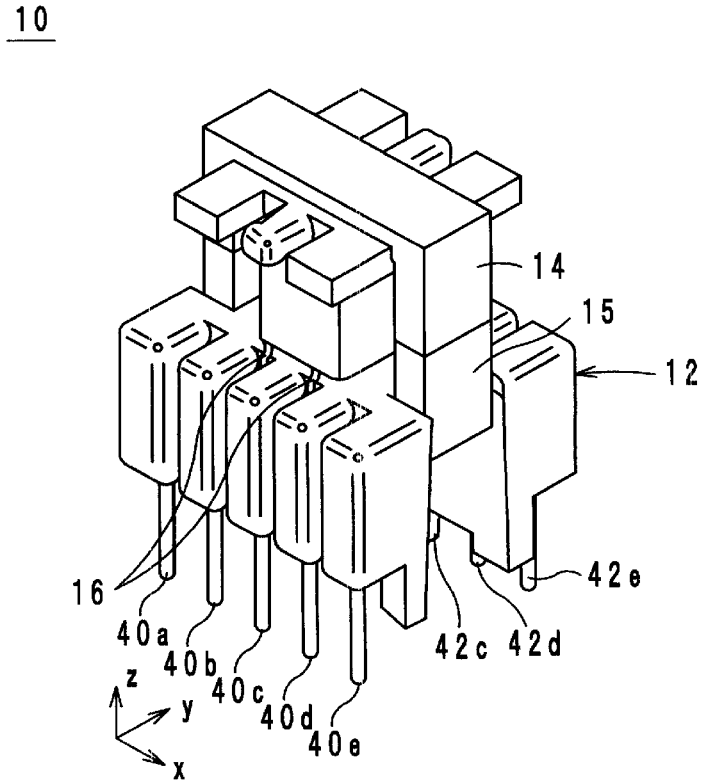
FIG. 1 is an external perspective view of a transformer coil according to a preferred embodiment of the present invention.
Figure 2:
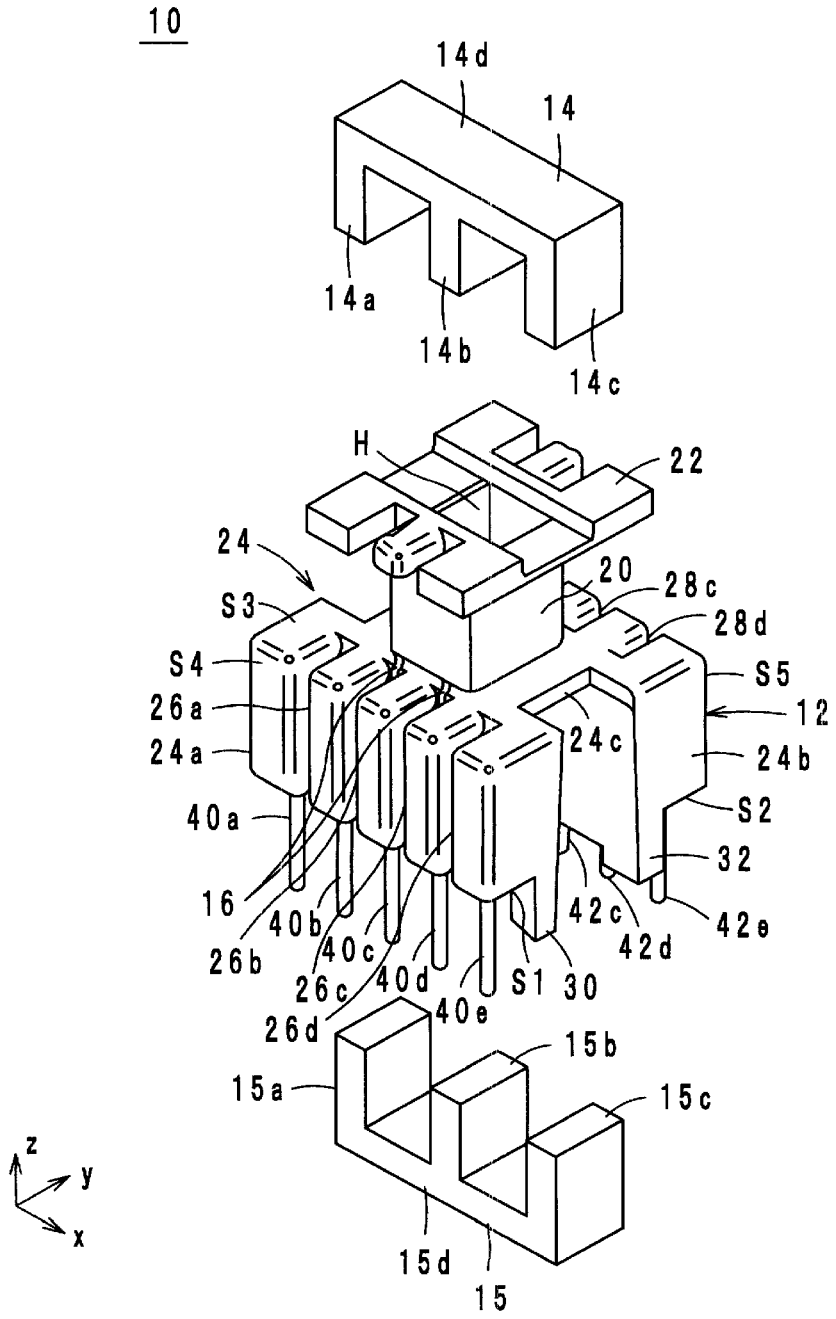
FIG. 2 is an external perspective view of a transformer coil according to a preferred embodiment of the present invention.
Figure 3:
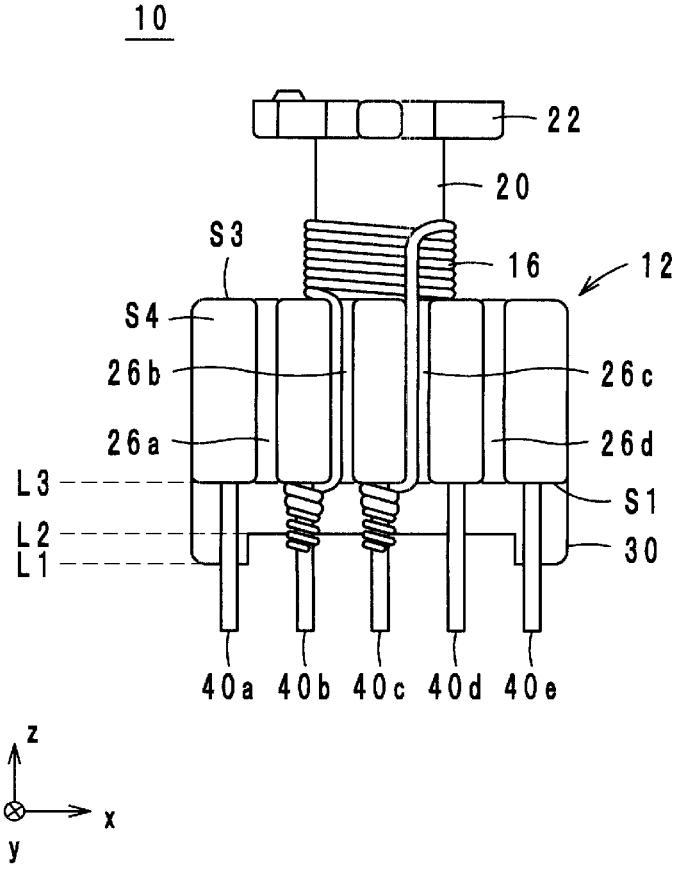
FIG. 3 is a plan view of a transformer coil in a state where a winding is exposed.
Figure 4A:
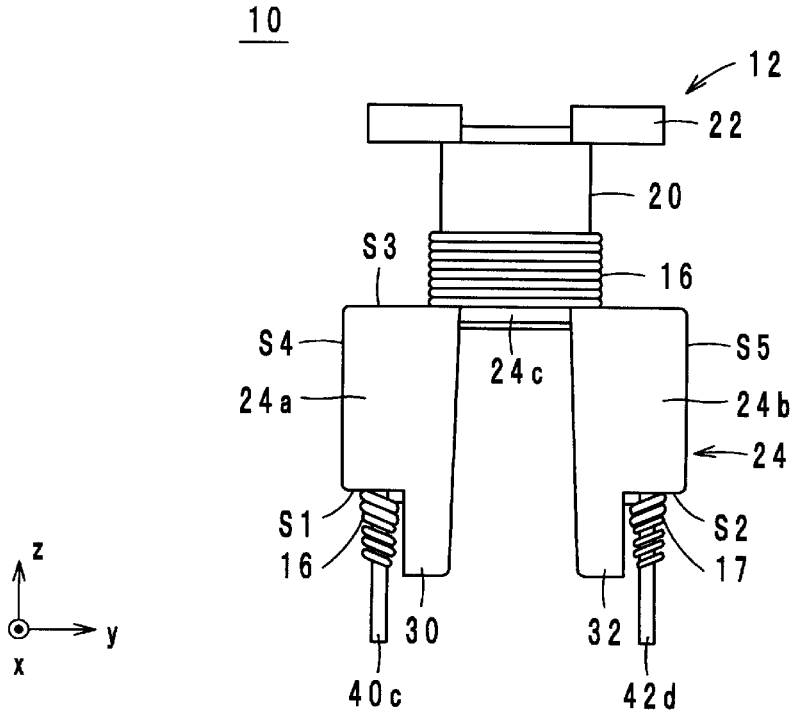
FIGS. 4A and 4B are plan views of a transformer coil in a state where a winding is exposed.
Figure 4B:
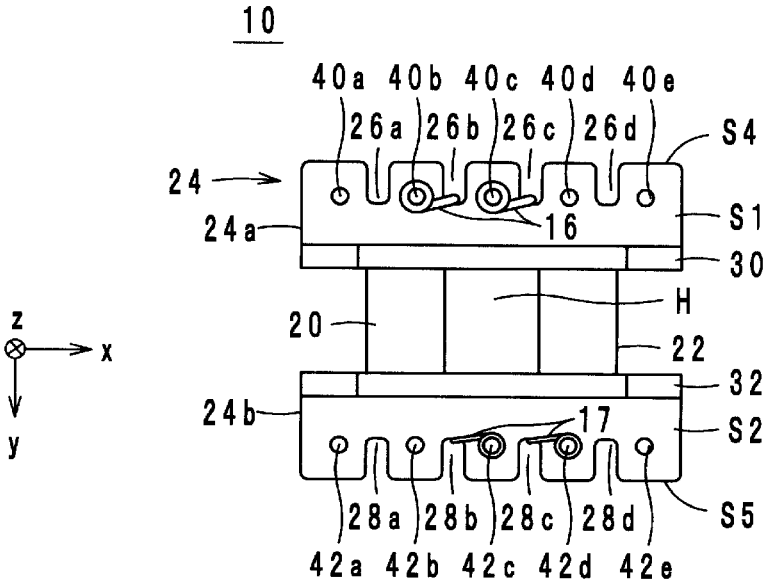
Figure 5:
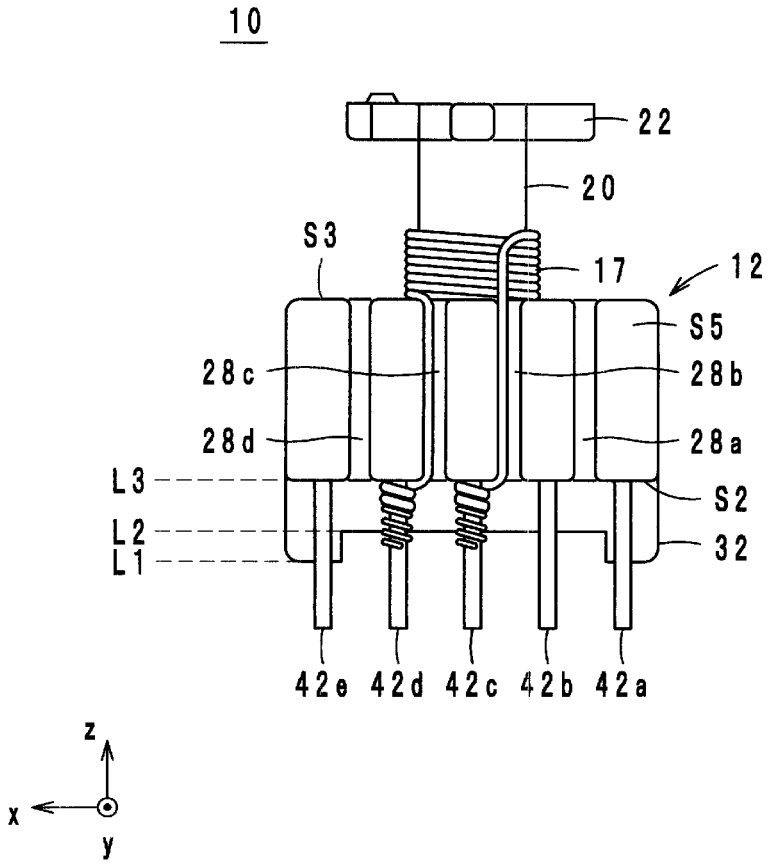
FIG. 5 is a plan view of a transformer coil in a state where a winding is exposed.

Hereinafter, the configuration of transformer coils according to preferred embodiments will be described with reference to the drawings. FIGS. 1 and 2 are external perspective views of a transformer coil 10 according to a preferred embodiment of the present invention. FIGS. 3, 4A and 4B are plan views of the transformer coil 10 in a state where a winding 16 is exposed. FIG. 5 is a plan view of the transformer coil 10 in a state where a winding 17 is exposed. In the following, a vertical direction is defined as a z-axis direction. A long-side direction of the transformer coil 10 in a plan view taken from the z-axis direction is defined as an x-axis direction, and a short-side direction of the transformer coil 10 in a plan view taken from the z-axis direction is defined as a y-axis direction. The x-axis direction, the y-axis direction, and the z-axis direction are perpendicular or substantially perpendicular to one another.

As shown in FIGS. 1 to 3, the transformer coil 10 includes a bobbin 12, cores 14 and 15, the winding 16, and pin terminals 40*a*-40*e* and 42*a*-42*e*. The bobbin 12 is preferably made of a resin, and includes a core portion 20, flange portions 22 and 24, and projecting portions 30 and 32, as shown in FIG. 2.

As shown in FIG. 5, the core portion 20 preferably is a quadrangular column-shaped member that extends in the z-axis direction. Although FIGS. 1 to 4B indicate the core portion 20 with a reference numeral, it should be noted that the core portion 20 is wrapped with the windings 16 and 17, an insulative tape, and so on, and is not exposed to the exterior. Meanwhile, as shown in FIG. 2, the core portion 20 is provided with a hole H that passes therethrough in the z-axis direction.

As shown in FIGS. 2 through 5, the flange portion 22 is provided at an end portion of the core portion 20 on a positive direction side of the z-axis direction, and protrudes from the core portion 20 in the x-axis direction and the y-axis direction (the directions perpendicular or substantially perpendicular to the z-axis direction). More specifically, the flange portion 22 includes a plate member that preferably has a rectangular or substantially rectangular shape when viewed in a plan view from the z-axis direction. The hole H is located in the center of the flange portion 22.

As shown in FIGS. 2 through 5, the flange portion 24 is provided at an end portion of the core portion 20 on a negative direction side of the z-axis direction, and protrudes from the core portion 20 in the x-axis direction and the y-axis direction (the directions perpendicular or substantially perpendicular to the z-axis direction). More specifically, the flange portion 24 includes side surface portions 24*a* and 24*b* and a connection portion 24*c*. The side surface portions 24*a* and 24*b* preferably are parallelepiped members having a long-side direction in the x-axis direction. The side surface portion 24*a* is provided farther on the negative direction side of the y-axis direction than the side surface portion 24*b*, and faces the side surface portion 24*b* with a space provided therebetween. The connection portion 24*c* includes a plate-shaped member provided on the negative direction side of the core portion 20 in the z-axis direction. The connection portion 24*c* connects the side surface portions 24*a* and 24*b*. Accordingly, the flange portion 24 preferably has an H shape when viewed in a plan view from the z-axis direction, as shown in FIG. 4B.

Here, a surface of the flange portion 24 on the positive direction side of the z-axis direction is called a surface S3. A surface of the side surface portion 24*a* on the negative direction side of the z-axis direction is called a surface S1. A surface of the side surface portion 24*b* on the negative direction side of the z-axis direction is called a surface S2. A surface of the side surface portion 24*a* on the negative direction side of the y-axis direction is called a side surface S4. A surface of the side surface portion 24*b* on the positive direction side of the y-axis direction is called a side surface S5.

Grooves 26*a*-26*d* that connect the surface S1 and the surface S3 are provided in the side surface S4 of the side surface portion 24*a*. The grooves 26*a*-26*d* extend in the z-axis direction, and are arranged in that order from the negative direction side toward the positive direction side of the x-axis direction. Grooves 28*a*-28*d* that connect the surface S2 and the surface S3 are provided in the side surface S5 of the side surface portion 24*b*. The grooves 28*a*-28*d* extend in the z-axis direction, and are arranged in that order from the negative direction side toward the positive direction side of the x-axis direction.

As shown in FIG. 2, the projecting portion 30 includes a plate-shaped member that projects from the surface S1 of the side surface portion 24*a* toward the negative direction side of the z-axis direction. More specifically, the projecting portion 30 extends along a side of the surface S1 of the side surface portion 24*a* on the positive direction side of the y-axis direction, and as shown in FIG. 3, preferably has a rectangular or substantially rectangular shape when viewed in a plan view from the y-axis direction. Note that a cutout is provided near the center of the long side of the projecting portion 30, on the negative direction side of the z-axis direction.

As shown in FIG. 2, the projecting portion 32 is a plate-shaped member that projects from the surface S2 of the side surface portion 24*b* toward the negative direction side of the z-axis direction. More specifically, the projecting portion 32 extends along a side of the surface S2 of the side surface portion 24*b* on the negative direction side of the y-axis direction, and as shown in FIG. 5, has a rectangular or substantially rectangular shape when viewed in a plan view from the y-axis direction. Note that a cutout is provided near the center of the long side of the projecting portion 32, on the negative direction side of the z-axis direction.

The pin terminals 40*a*-40*e* are metal pins that extend from the surface S1 of the side surface portion 24*a* toward the negative direction side of the z-axis direction. The pin terminal 40*a* is provided farther toward the negative direction side of the x-axis direction than the groove 26*a*. The pin terminal 40*b* is provided between the groove 26*a* and the groove 26*b*. The pin terminal 40*c* is provided between the groove 26*b* and the groove 26*c*. The pin terminal 40*d* is provided between the groove 26*c* and the groove 26*d*. The pin terminal 40*e* is provided farther toward the positive direction side of the x-axis direction than the groove 26*d*. The pin terminals 40*a*-40*e* are preferably configured integrally with the bobbin 12 through resin molding, or are inserted into the bobbin 12 later.

The pin terminals 42*a*-42*e* are metal pins that extend from the surface S2 of the side surface portion 24*b* toward the negative direction side of the z-axis direction. The pin terminal 42*a* is provided farther toward the negative direction side of the x-axis direction than the groove 28*a*. The pin terminal 42*b* is provided between the groove 28*a* and the groove 28*b*. The pin terminal 42*c* is provided between the groove 28*b* and the groove 28*c*. The pin terminal 42*d* is provided between the groove 28*c* and the groove 28*d*. The pin terminal 42*e* is provided farther toward the positive direction side of the x-axis direction than the groove 28*d*. The pin terminals 42*a*-42*e* are preferably configured integrally with the bobbin 12 through resin molding, or are inserted into the bobbin 12 later.

As shown in FIG. 5, the winding 17 is a primary winding wrapped around the core portion 20. Accordingly, the winding 17 defines a coil. The winding 17 is guided by the grooves 28*b* and 28*c*, and is drawn out from the surface S3 of the side surface portion 24*b* to the surface S2 via the side surface S5. One end of the winding 17 is wrapped in a helix shape multiple times around the vicinity of an end portion of the pin terminal 42*c* on the positive direction side of the z-axis direction. Another end of the winding 17 is wrapped in a helix shape multiple times around the vicinity of an end portion of the pin terminal 42*d* on the positive direction side of the z-axis direction. End portions of the winding 17, on the negative direction side of the z-axis direction, that are wrapped around the pin terminals 42*c* and 42*d* are located farther in the positive direction of the z-axis direction than an end portion of the projecting portion 32 on the negative direction side of the z-axis direction, as shown in FIG. 4A.

A conducting wire such as a polyurethane enameled wire, abbreviated as UEW, is used as the winding 17, for example. In other words, the surface of the winding 17 is covered with an insulative material. Although not shown in the drawings, an insulative tape is wrapped around the core portion 20 around which the winding 17 is wrapped.

Both ends of the winding 17 as described thus far are soldered to the pin terminals 42*c* and 42*d*, respectively. The soldering is performed preferably by dipping the pin terminals 42*c* and 42*d* around which the winding 17 is wrapped into a solder liquid. In FIG. 5, a location of an end portion of the projecting portion 32 on the negative direction side of the z-axis direction is indicated as a location L1, and a location of the surface S2 is indicated as a location L3. The pin terminals 42*c* and 42*d* are dipped so that the liquid surface of the solder liquid is at a location L2 that is between the location L1 and the location L3. The location L2 is located farther toward the positive direction side of the z-axis direction than end portions, on the negative direction side of the z-axis direction, of the portions of the winding 17 that are wrapped around the pin terminals 42*c* and 42*d*. Accordingly, the portions of the winding 17 that are wrapped around the pin terminals 42*c* and 42*d* are also partially dipped in the solder liquid. The covering of the portions of the winding 17 dipped in the solder liquid is thus melted by heat from the solder liquid. Furthermore, the covering of a portion of the winding 17 farther toward the positive direction side of the z-axis direction than the location L2 is melted due to the solder liquid wetting upward along the winding 17 and heat from the solder liquid being transmitted to the winding 17 and the pin terminals 42*c* and 42*d*. However, the covering at a portion of the winding 17 near the location L3 is not melted. Accordingly, both ends of the winding 17 are soldered to the pin terminals 42*c* and 42*d*, respectively, in a region between the end portion of the projecting portion 32 on the negative direction side of the z-axis direction (the location L1) and the surface S2 of the side surface portion 24*b* (the location L3). In other words, the solder does not adhere to the surface S2. Note that in FIG. 5, the portions of the winding 17 from which the covering has been melted (called "bare wire" hereinafter) are illustrated as being narrower than the portions of the winding 17 from which the covering has not been melted.

As shown in FIG. 3, the winding 16 is a secondary winding that is wrapped around the core portion 20, around which are wrapped the winding 17 and the insulative tape, so as to circle in the same direction as the winding 17. Accordingly, the winding 16 defines a coil. The winding 16 is guided by the grooves 26*b* and 26*c*, and is drawn out from the surface S3 of the side surface portion 24*a* to the surface S1 via the side surface S4. One end of the winding 16 is wrapped in a helix shape multiple times around the vicinity of an end portion of the pin terminal 40*b* on the positive direction side of the z-axis direction. Another end of the winding 16 is wrapped in a helix shape multiple times around the vicinity of an end portion of the pin terminal 40*c* on the positive direction side of the z-axis direction. As shown in FIG. 4A, end portions, on the negative direction side of the z-axis direction, of the portions of the winding 16 that are wrapped around the pin terminals 40*b* and 40*c* respectively, are located farther on the positive direction side of the z-axis direction than the end portion of the projecting portion 30 on the negative direction side of the z-axis direction, and are in the same or substantially the same location, in the z-axis direction, as the end portions, on the negative direction side of the z-axis direction, of the portions of the winding 17 that are wrapped around the pin terminals 42*c* and 42*d*.

A three-layer insulated wire, for example, is preferably used as the winding 16. In a three-layer insulated wire, a conductor is covered by three layers of an insulative film. As such, the winding 16 is better insulated than the winding 17. A diameter of the winding 16 is greater than a diameter of the winding 17. Although not shown in the drawings, an insulative tape is wrapped around the core portion 20 around which the winding 16 is wrapped.

A pitch between the portions of the winding 16 that are wrapped around the pin terminals 40*b* and 40*c* is equal or substantially equal to a pitch between the portions of the winding 17 that are wrapped around the pin terminals 42*c* and 42*d*. However, as mentioned earlier, the diameter of the winding 16 is greater than the diameter of the winding 17. Accordingly, the size of a gap in the z-axis direction between adjacent portions of the winding 16 at the pin terminals 40*b* and 40*c* is smaller than the size of a gap in the z-axis direction between adjacent portions of the winding 17 at the pin terminals 42*c* and 42*d*.

Both ends of the winding 16 as described thus far are soldered to the pin terminals 40*b* and 40*c*, respectively. The soldering is performed preferably by dipping the pin terminals 40*b* and 40*c* around which the winding 16 is wrapped into a solder liquid. In FIG. 3, a location of an end portion of the projecting portion 30 on the negative direction side of the z-axis direction is indicated as the location L1, and a location of the surface S1 is indicated as the location L3. The pin terminals 40*b* and 40*c* are dipped so that the liquid surface of the solder liquid is at the location L2 that is between the location L1 and the location L3. The location L2 is located farther toward the positive direction side of the z-axis direction than end portions, on the negative direction side of the z-axis direction, of the portions of the winding 16 that are wrapped around the pin terminals 40*b* and 40*c*. Accordingly, the portions of the winding 16 that are wrapped around the pin terminals 40*b* and 40*c* are also partially dipped in the solder liquid. The covering of the portions of the winding 16 dipped in the solder liquid is thus melted by heat from the solder liquid. Furthermore, the covering of a portion of the winding 16 farther toward the positive direction side of the z-axis direction than the location L2 is melted due to the solder liquid wetting upward along the winding 16 and heat from the solder liquid being transmitted to the winding 16 and the pin terminals 40*b* and 40*c*. However, the covering at a portion of the winding 16 near the location L3 is not melted. Accordingly, both ends of the winding 16 are soldered to the pin terminals 40*b* and 40*c*, respectively, in a region between the end portion of the projecting portion 30 on the negative direction side of the z-axis direction (the location L1) and the surface S1 of the side surface portion 24*a* (the location L3). The solder does not adhere to the surface S1. Note that in FIG. 3, the bare wire portions of the winding 16 are illustrated as being narrower than the portions of the winding 16 from which the covering has not been melted.

As shown in FIG. 2, the core 14 preferably has an E shape, and includes outer peripheral portions 14*a*, 14*c*, and 14*d* and a core portion 14*b*. The outer peripheral portion 14*a*, the core portion 14*b*, and the outer peripheral portion 14*c* extend in the z-axis direction, and are arranged in that order from the negative direction side toward the positive direction side of the x-axis direction. The outer peripheral portion 14*d* extends in the x-axis direction. End portions of the outer peripheral portions 14*a* and 14*c* and the core portion 14*b* on the positive direction side of the z-axis direction are connected to the outer peripheral portion 14*d*. The core 14 is configured of, for example, a magnetic material such as an Mn—Zn-based ferrite or the like.

As shown in FIG. 2, the core 15 preferably has an E shape, and includes outer peripheral portions 15*a*, 15*c*, and 15*d* and a core portion 15*b*. The outer peripheral portion 15*a*, the core portion 15*b*, and the outer peripheral portion 15*c* extend in the z-axis direction, and are arranged in that order from the negative direction side toward the positive direction side of the x-axis direction. The outer peripheral portion 15*d* extends in the x-axis direction. End portions of the outer peripheral portions 15*a* and 15*c* and the core portion 15*b* on the negative direction side of the z-axis direction are connected to the outer peripheral portion 15*d*. The core 15 is preferably configured of, for example, a magnetic material such as an Mn—Zn-based ferrite or the like.

The core 14 is attached to the bobbin 12 by the core portion 14*b* being inserted into the hole H from the positive direction side of the z-axis direction. Likewise, the core 15 is attached to the bobbin 12 by the core portion 15*b* being inserted into the hole H from the negative direction side of the z-axis direction. As a result, a tip portion of the outer peripheral portion 14*a* and a tip portion of the outer peripheral portion 15*a* are joined, a tip portion of the outer peripheral portion 14*c* and a tip portion of the outer peripheral portion 15*c* are joined, and a tip portion of the core portion 14*b* and a tip portion of the core portion 15*b* are joined. The outer peripheral portions 14*a*, 14*c*, 14*d*, 15*a*, 15*c*, and 15*d* encircle the periphery of the coils of the windings 16 and 17. The core portions 14*b* and 15*b* pass through each coil interior of the windings 16 and 17.

The transformer coil 10 according to the present preferred embodiment prevents the covering of the portions of the windings 16 and 17 aside from the portions wrapped around the pin terminals 40*b*, 40*c*, 42*c*, and 42*d* from melting. More specifically, according to the transformer coil 500 disclosed in Japanese Unexamined Patent Application Publication No. 8-162336, when the pin terminal 510 is dipped into the solder liquid, the liquid surface of the solder liquid is located at the base of the pin terminal 510 (that is, the location L0). In this case, there is thus a risk that the cover of the winding 520 located within the groove 512 will be melted by heat transmitted from the solder liquid.

On the other hand, according to the transformer coil 10, the pin terminals 40*b* and 40*c* are dipped so that the liquid surface of the solder liquid is at the location L2 that is between the location L1 and the location L3. The location L2 is located farther toward the positive direction side of the z-axis direction than end portions, on the negative direction side of the z-axis direction, of the portions of the winding 16 that are wrapped around the pin terminals 40*b* and 40*c*. Accordingly, the portions of the winding 16 that are wrapped around the pin terminals 40*b* and 40*c* are also partially dipped in the solder liquid. The covering of the portions of the winding 16 dipped in the solder liquid is thus melted by heat from the solder liquid. Furthermore, the covering of a portion of the winding 16 farther toward the positive direction side of the z-axis direction than the location L2 is melted due to the solder liquid wetting upward along the winding 16 and heat from the solder liquid being transmitted to the winding 16 and the pin terminals 40*b* and 40*c*. As a result, the bare wire of the winding 16 and the pin terminals 40*b* and 40*c* are connected by the solder. Accordingly, both ends of the winding 16 are soldered to the pin terminals 40*b* and 40*c*, respectively, in a region between the end portion of the projecting portion 30 on the negative direction of the z-axis direction (the location L1) and the surface S1 of the side surface portion 24A (the location L3).

However, the location L2 of the liquid surface of the solder liquid is distanced from the location L3 of the surface S1, and thus the covering at a portion of the winding 16 near the location L3 is not melted. Accordingly, the covering of the portions of the winding 16 aside from the portions wrapped around the pin terminals 40*b* and 40*c* (for example, the portions located in the grooves 26*b* and 26*c*) is prevented from melting. Note that the covering of the portions of the winding 17 aside from the portions wrapper around the pin terminals 42*c* and 42*d* (for example, the portions located in the grooves 28*b* and 28*c*) are also prevented from melting for the same reasons.

Here, according to the IEC 950 standard, there must not be equal to or more than 6.4 mm of bare wire between the primary winding and a soldered area of the secondary winding in a transformer coil. According to the IEC 65 standard, there must not be equal to or more than 6.0 mm of bare wire, and according to the UL standard, there must not be equal to or more than 3.2 mm of bare wire. Accordingly, with the transformer coil 500 disclosed in Japanese Unexamined Patent Application Publication No. 8-162336, it has been necessary to, for example, increase the vertical thickness of the lower flange 508 of the coil bobbin 502 and increase the distance from the primary winding to the soldered area of the secondary winding in cases where the covering of the winding 520 located within the groove 512 will also melt. This increases the height of the transformer coil 500.

Accordingly, the transformer coil 10 prevents the covering of the portions of the windings 16 and 17 aside from the portions wrapper around the pin terminals 40*b*, 40*c*, 42*c*, and 42*d* from melting. As a result, the distance from the winding 17 to the soldered portion of the winding 16 (the portion where the cover has melted) is prevented from decreasing. As a result, it is not necessary to increase the height of the flange portion 24 in the z-axis direction. The transformer coil 10 has a lower profile as a result.

Furthermore, with the transformer coil 10, both ends of the winding 16 are preferably soldered to the pin terminals 40*b* and 40*c* at the same time as both ends of the winding 17 are soldered to the pin terminals 42*c* and 42*d*. More specifically, as shown in FIG. 4A, the end portions, on the negative direction side of the z-axis direction, of the portions of the winding 16 that are wrapped around the pin terminals 40*b* and 40*c* respectively, are in the same or substantially the same position in the z-axis direction as the end portions, on the negative direction side of the z-axis direction, of the portions of the winding 17 that are wrapped around the pin terminals 42*c* and 42*d*. Through this, the winding 16 and the winding 17 are capable of being dipped into the solder liquid simultaneously. As a result, both ends of the winding 16 preferably are soldered to the pin terminals 40*b* and 40*c* at the same time as both ends of the winding 17 are soldered to the pin terminals 42*c* and 42*d*.

First Variation

Figure 6:
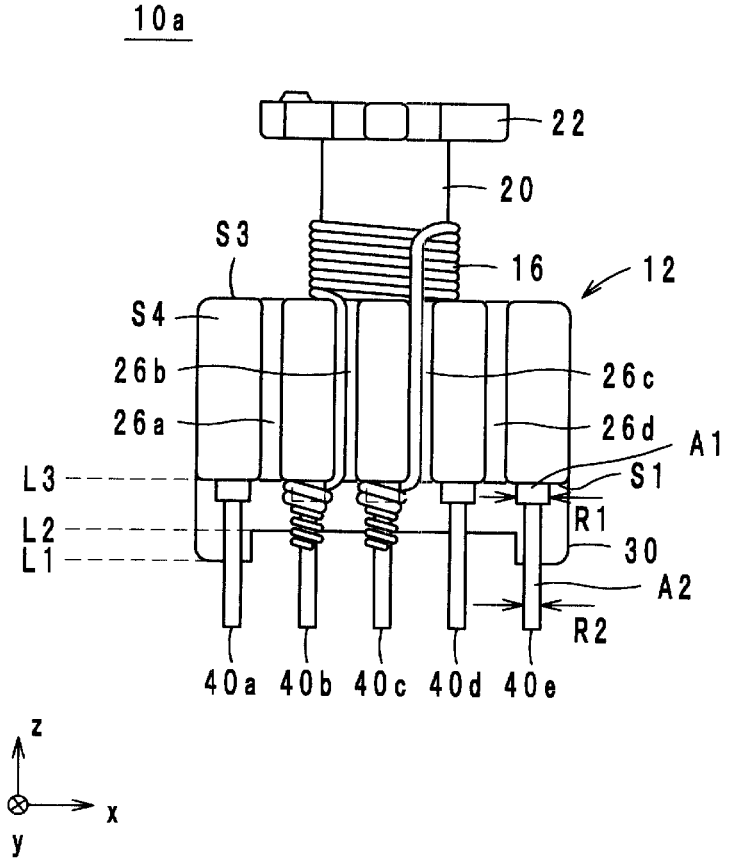
FIG. 6 is a plan view of a transformer coil according to a first variation of a preferred embodiment of the present invention, in a state where a winding is exposed.

Hereinafter, a transformer coil according to a first variation of a preferred embodiment of the present invention will be described with reference to the drawings. FIG. 6 is a plan view of a transformer coil 10*a* according to the first variation in a state where the winding 16 is exposed.

The transformer coil 10*a* differs from the transformer coil 10 in terms of the shapes of the pin terminals 40*a*-40*e*. More specifically, in the transformer coil 10*a*, the pin terminals 40*a*-40*e* have a base portion A1, which has a diameter R1 and makes contact with the surface S1, and a tip portion A2, which has a diameter R2 that is smaller than the diameter R1 and is provided farther on the negative direction side of the z-axis direction than the base portion A1. The winding 16 is wrapped around both the base portion A1 and the tip portion A2.

In the transformer coil 10*a* configured as described above, the base portion A1 is wider than the diameter of the tip portion A2. Accordingly, the length of the winding 16 wrapped around the pin terminals 40*b* and 40*c* in the transformer coil 10*a* is greater than the length of the winding 16 wrapped around the pin terminals 40*b* and 40*c* in the transformer coil 10, even in the case where there is the same number of turns. Accordingly, heat from the solder liquid is transmitted through the transformer coil 10*a* toward the positive direction side in the z-axis direction slower in the transformer coil 10*a* than in the transformer coil 10. Accordingly, the covering of the winding 16 melts less easily in the transformer coil 10*a* than in the transformer coil 10.

Note that the pin terminals 42*a*-42*e* may also have the same shapes as the pin terminals 40*a*-40*e*. Furthermore, rather than widening the base portions A1 of the pin terminals 40*a*-40*e* and 42*a*-42*e* themselves, the base portions A1 of the pin terminals 40*a*-40*e* and 42*a*-42*e* may be widened using projections from the bobbin 12 or the like.

Second Variation

Figure 7A:
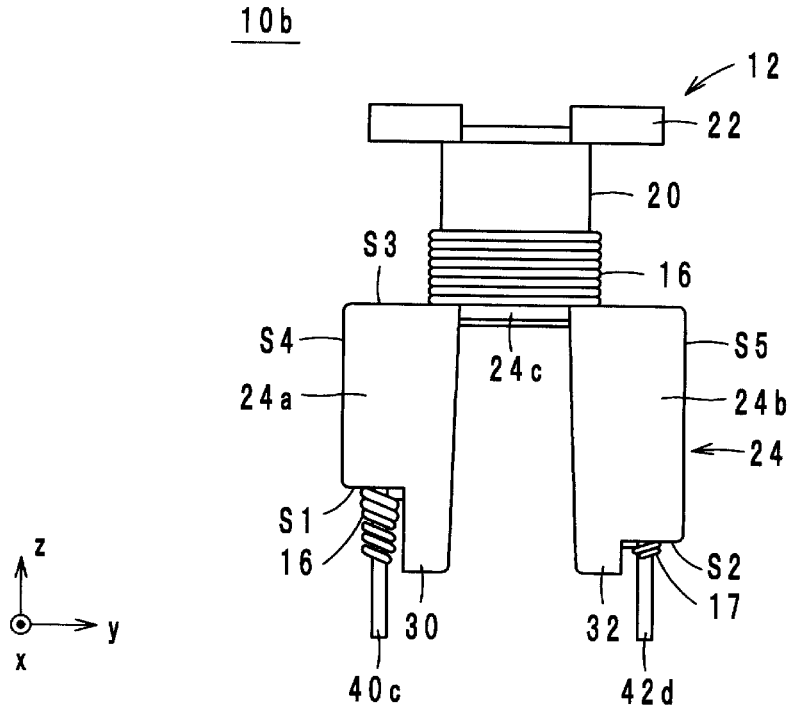
FIGS. 7A and 7B are plan views of a transformer coil according to a second variation of a preferred embodiment of the present invention, in a state where a winding is exposed.
Figure 7B:
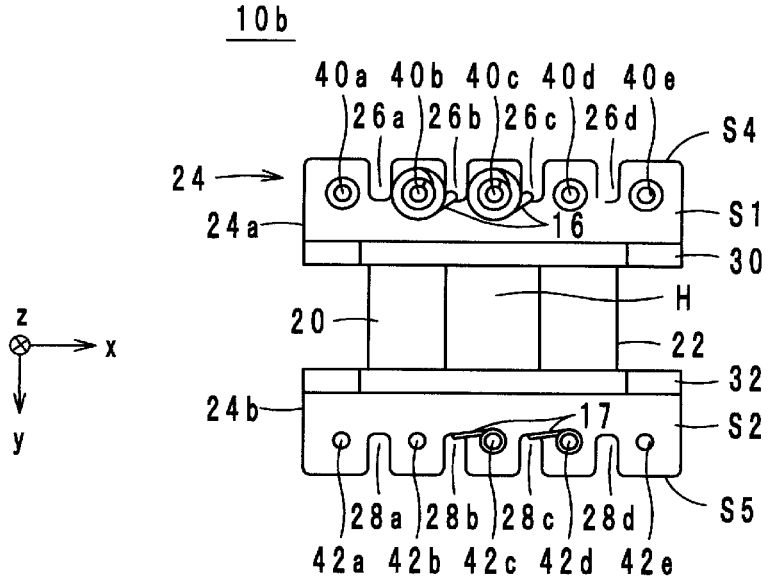
Figure 8:
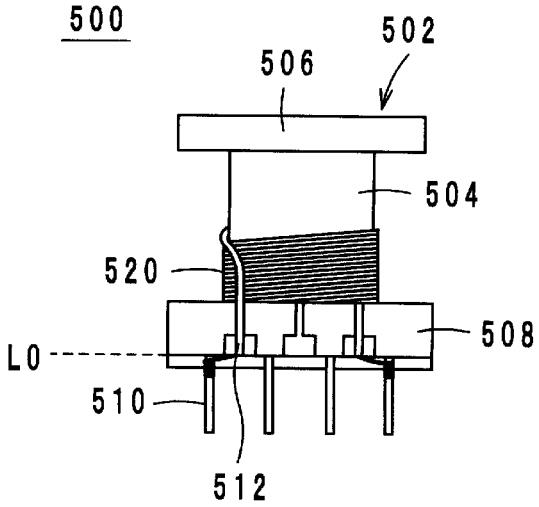
FIG. 8 PRIOR ART
FIG. 8 is a plan view of a transformer coil disclosed in Japanese Unexamined Patent Application Publication No. 8-162336.

Hereinafter, a transformer coil according to a second variation of a preferred embodiment of the present invention will be described with reference to the drawings. FIGS. 7A and 7B are plan views of a transformer coil 10*b* according to the second variation in a state where the winding 16 is exposed.

The transformer coil 10*b* differs from the transformer coil 10 in terms of the location of the surface S2 of the side surface portion 24*b* on the negative direction side of the z-axis direction. More specifically, in the transformer coil 10*b*, the surface S2 is located farther toward the negative direction side of the z-axis direction than the surface S1.

In the case where a conducting wire such as a polyurethane enameled wire, abbreviated as UEW, is used as the winding 17, it does not matter whether or not the covering of the portions located within the grooves 28*b* and 28*c* melts. Accordingly, the surface S2 may be located farther toward the negative direction side of the z-axis direction than the surface S1. As a result, the number of times the winding 17 is wrapped around the pin terminals 42*c* and 42*d* is reduced. In other words, the number of turns in the winding 17 around the pin terminals 42*c* and 42*d* is smaller than the number of turns in the winding 16 around the pin terminals 40*b* and 40*c* (is different, in other words). As a result, the process for wrapping the winding 17 around the pin terminals 42*c* and 42*d* is simplified. In addition, the number of turns is smaller, and thus the length of the winding 17 is reduced. Furthermore, an unnecessary inductance component is prevented from arising in the winding 17.

Other Preferred Embodiments

The transformer coil according to the present invention is not limited to the transformer coils 10, 10*a*, and 10*b*, and can be modified without departing from the essential spirit thereof.

Note that the winding 16 may be the primary winding and the winding 17 may be the secondary winding.

Various preferred embodiments of the present invention and variations thereof are useful in transformer coils, and are particularly useful to prevent a covering of portions of a winding aside from portions wrapper around a terminal from melting.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

The invention claimed is:

1. A transformer coil comprising:

a bobbin including a core portion extending in a predetermined direction, a flange portion at an end of the core portion on one side of the predetermined direction and extending from the core portion in a perpendicular or substantially perpendicular direction that is perpendicular or substantially perpendicular to the predetermined direction, and a projecting portion projecting toward the one side in the predetermined direction from a first surface on one side of the flange portion in the predetermined direction;

two first terminals projecting from the first surface of the flange portion toward the one side in the predetermined direction; and a first winding including a portion wrapped around the core portion and two ends respectively wrapped around the two first terminals; wherein the two ends of the first winding are respectively soldered by solder to the two first terminals at a region between an end portion of the projecting portion on the one side in the predetermined direction and the first surface of the flange portion;

the first winding includes a covering made of insulative material;

at a portion of the first winding adjacent to the first surface of the flange portion, the covering is not melted;

the solder is not adhered to the first surface of the flange portion;

a portion of each of the two ends of the first winding is wrapped around a respective one of the two first terminals in a helix shape, and the covering on the portion of each of the two ends of the first winding that is wrapped around the respective one of the two first terminals is not melted;

the first winding includes a drawn-out portion extending between the portion of the first winding wrapped around the core portion and the two ends of the first winding; and the covering on the drawn-out portion of the first winding is not melted.

2. The transformer coil according to claim 1, further comprising:

two second terminals projecting toward the one side in the predetermined direction from a second surface of the flange portion on the one side in the predetermined direction; and a second winding including a portion wrapped around the core portion and two ends respectively wrapped around the two second terminals; wherein the two ends of the second winding are respectively soldered to the two second terminals at a region between an end portion of the projecting portion on the one side in the predetermined direction and the second surface of the flange portion.

3. The transformer coil according to claim 2, wherein the portion of the first winding that is wrapped around the first terminal in the helix shape, and an end portion, on the one side in the predetermined direction, of a portion of the second winding that is wrapped around the second terminal are in a same or substantially the same location in the predetermined direction.

4. The transformer coil according to claim 2, wherein the first winding is a three-layer insulated wire;

the second winding is a conducting wire;

a portion of the second winding is wrapped around a respective one of the two second terminals in a helix shape; and a pitch of the portion of the first winding wrapped around the first terminal in the helix shape is equal or substantially equal to a pitch of the portion of the second winding wrapped around the second terminal in the helix shape.

5. The transformer coil according to claim 3, wherein
the first winding is a three-layer insulated wire;
the second winding is a conducting wire;
a portion of the second winding is wrapped around a respective one of the two second terminals in a helix shape; and
a pitch of the portion of the first winding wrapped around the first terminal in the helix shape is equal or substantially equal to a pitch of the portion of the second winding wrapped around the second terminal in the helix shape.

6. The transformer coil according to claim 2, wherein the first surface and the second surface are at different locations in the predetermined direction.

7. The transformer coil according to claim 3, wherein the first surface and the second surface are at different locations in the predetermined direction.

8. The transformer coil according to claim 4, wherein the first surface and the second surface are at different locations in the predetermined direction.

9. The transformer coil according to claim 5, wherein the first surface and the second surface are at different locations in the predetermined direction.

10. The transformer coil according to claim 6, wherein a number of turns in the first winding around the first terminal is different from a number of turns in the second winding around the second terminal.

11. The transformer coil according to claim 7, wherein a number of turns in the first winding around the first terminal is different from a number of turns in the second winding around the second terminal.

12. The transformer coil according to claim 8, wherein a number of turns in the first winding around the first terminal is different from a number of turns in the second winding around the second terminal.

13. The transformer coil according to claim 9, wherein a number of turns in the first winding around the first terminal is different from a number of turns in the second winding around the second terminal.

14. The transformer coil according to claim 1, wherein
a plurality of grooves that connect a third surface of the flange portion on another side in the predetermined direction with the first surface are provided in a side surface of the flange portion on the one side in the perpendicular or substantially perpendicular direction; and
the first winding is guided by the grooves.

15. The transformer coil according to claim 2, wherein
a plurality of grooves that connect a third surface of the flange portion on another side in the predetermined direction with the first surface are provided in a side surface of the flange portion on the one side in the perpendicular or substantially perpendicular direction; and
the first winding is guided by the grooves.

16. The transformer coil according to claim 3, wherein
a plurality of grooves that connect a third surface of the flange portion on another side in the predetermined direction with the first surface are provided in a side surface of the flange portion on the one side in the perpendicular or substantially perpendicular direction; and
the first winding is guided by the grooves.

17. The transformer coil according to claim 4, wherein
a plurality of grooves that connect a third surface of the flange portion on another side in the predetermined direction with the first surface are provided in a side surface of the flange portion on the one side in the perpendicular or substantially perpendicular direction; and
the first winding is guided by the grooves.

18. The transformer coil according to claim 5, wherein
a plurality of grooves that connect a third surface of the flange portion on another side in the predetermined direction with the first surface are provided in a side surface of the flange portion on the one side in the perpendicular or substantially perpendicular direction; and
the first winding is guided by the grooves.

19. The transformer coil according to claim 6, wherein
a plurality of grooves that connect a third surface of the flange portion on another side in the predetermined direction with the first surface are provided in a side surface of the flange portion on the one side in the perpendicular or substantially perpendicular direction; and
the first winding is guided by the grooves.

20. The transformer coil according to claim 1, wherein
the first terminal includes a base portion that has a first diameter and makes contact with the first surface, and a tip portion that has a second diameter that is smaller than the first diameter and that is provided farther toward the one side in the predetermined direction than the base portion; and
the winding is wrapped around both the base portion and the tip portion.

* * * * *